United States Patent [19]

Coquery et al.

[11] 3,974,666

[45] Aug. 17, 1976

[54] APPARATUS FOR BATCH TREATMENT OF TEXTILE MATERIALS

[75] Inventors: Jean-Paul Coquery, St. Didier au Mont d'Or; Pierre Labedan, Crepieux la Pape; Raymond Roland, Meyzieu, all of France

[73] Assignee: S.T.X., Groupement d'Interet Economique, Neuilly sur Seine, France

[22] Filed: Apr. 2, 1975

[21] Appl. No.: 564,344

[30] Foreign Application Priority Data

Apr. 12, 1974 France ..... 74.13625

[52] U.S. Cl. ..... 68/8; 34/104; 68/198; 118/50

[51] Int. Cl.[2] ..... D06B 5/18

[58] Field of Search ..... 68/189, 198, 7, 8, 20, 68/150; 34/104; 118/50

[56] References Cited

UNITED STATES PATENTS

| | | | |
|---|---|---|---|
| 1,259,839 | 3/1918 | Dudley | 68/150 |
| 1,331,743 | 2/1920 | Dudley | 68/150 |
| 1,331,744 | 2/1920 | Dudley | 68/189 X |
| 2,350,191 | 5/1944 | Raymond | 68/198 X |
| 3,685,324 | 8/1972 | Vorderbruegge et al. | 68/150 |

FOREIGN PATENTS OR APPLICATIONS

| | | | |
|---|---|---|---|
| 735,947 | 8/1955 | United Kingdom | 68/7 |

*Primary Examiner*—Philip R. Coe

[57] ABSTRACT

An improved apparatus for batch treatment of textile materials in the form of broad widths is provided in which an enclosure is provided with a closure means at its ends and having provision interiorally for two perforated hemi-cylindrical plates placed concentrically in the lower and upper parts of said enclosure and said plates being movable according to vertical translation; said enclosure preferably being cylindrical and having a ratio of length to diameter of between about 1 and 10:1.

5 Claims, 2 Drawing Figures

APPARATUS FOR BATCH TREATMENT OF TEXTILE MATERIALS

BACKGROUND OF THE INVENTION

The present invention relates to an improved apparatus for batch treatment of textile materials of natural, artificial or synthetic origin or their mixtures, in the form of broad width and loomed materials, including meshed or woven fabrics, non-woven fabrics, cloths, carpets, and so forth.

The word "treatment" as used herein includes all the operations in aqueous media or in organic solvent applied to textile materials, such as degreasing, desizing, removal of marking dyes, dyeing, and also the subsequent operations which follow thereafter, such as drying, greasing, water-proofing, fire-proofing, anti-static treatment, and so forth.

Also, the term "treatment fluid" as used herein includes all the liquid or gaseous fluids constituting the baths for treatments, such as degreasing, dyeing, drying, and so forth. It is known that, when textile materials such as broad cloths are treated on long beams, it is necessary to press strongly the spires of the fabric and impose to the treatment bath very high pressures. It is necessary, indeed, to obtain a complete impregnation of the textile mass and to treat the entirety of the piece of fabric in an homogeneous manner.

For this type of treatment, there is employed, for example, an apparatus comprising an enclosed vessel equipped along its axis with a perforated cylinder, having discs or flanges at its ends, to form a bobbin, on which the textile material is wound and through which a forced circulation of treatment bath is provided.

When delicate and/or compressible textiles are treated, such as jerseys or carpets, the fabrics cannot be rolled up in closely wound layers, because this would result in an unacceptable deformation of the fabric. But when the treatment bath is drawn off after treatment, the liquid is accumulated in the lower part of the textile bobbin, which leads to crushing and elongation, and deformation of the higher part of the spires. Moreover, it is clear that the moisture contents in the upper and lower parts of the bobbin are greatly different. A deformation of the textile may also occur during the treatments.

On the other hand, when baths comprising organic solvents are used, it is necessary not to effect, for safety reasons, manipulations of pieces of textiles, so long as these contain a considerable quantity of solvent. Therefore, the successive operations of treatment, including drying, are effected in the same enclosed vessel. If these operations are effected in an apparatus, such as described hereinabove, comprising a simple perforated cylinder, and if the mass of fabric includes differences of moisture contents, as has been shown, an irregular drying is obtained.

We have now invented an apparatus, which obviates the recited disadvantages as it prevents the deformation of textile materials and permits their treatment in an homogeneous and regular manner. It is particularly adapted for treatment of delicate and/or compressible textiles and for the realization of operating cycles comprising at least a step in which an organic solvent is employed. This apparatus is nevertheless usable for any type of textile material and for treatments with any type of liquid or gaseous fluid, by reason of the improvements it provides.

It is, accordingly, an object of the present invention to provide an apparatus for the batch treatment of textile materials which does not have the disadvantages of the prior art.

It is a further object of the present invention to provide an apparatus for the treatment of textiles which prevents deformation of the textiles.

Other objects of the invention will be apparent to those skilled in the textile art from the present description, taken in conjunction with the appended drawings, in which.

GENERAL DESCRIPTION OF THE INVENTION

Figure 1:
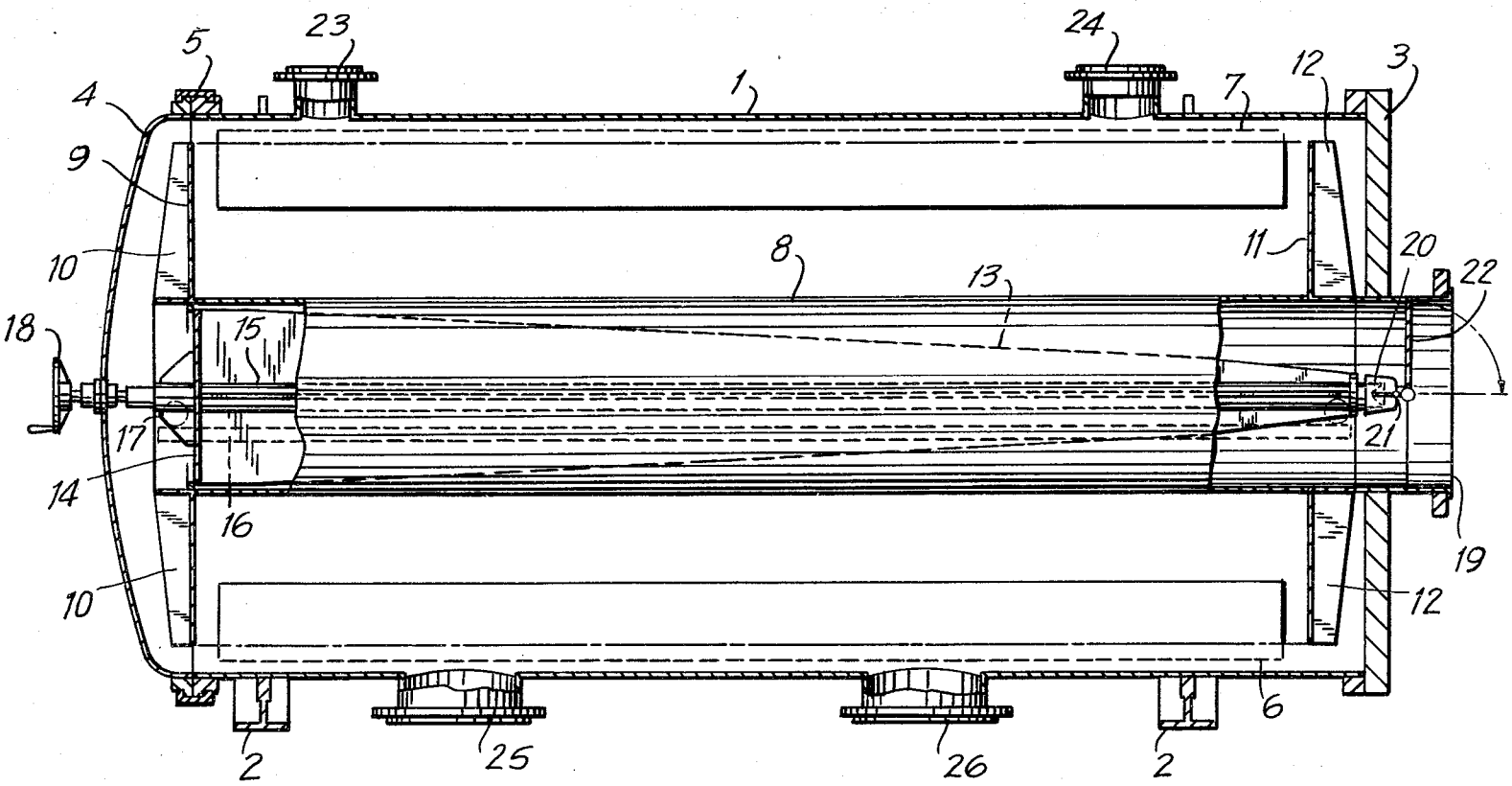
FIG. 1 is a vertical section along the length of the apparatus.
Figure 2:
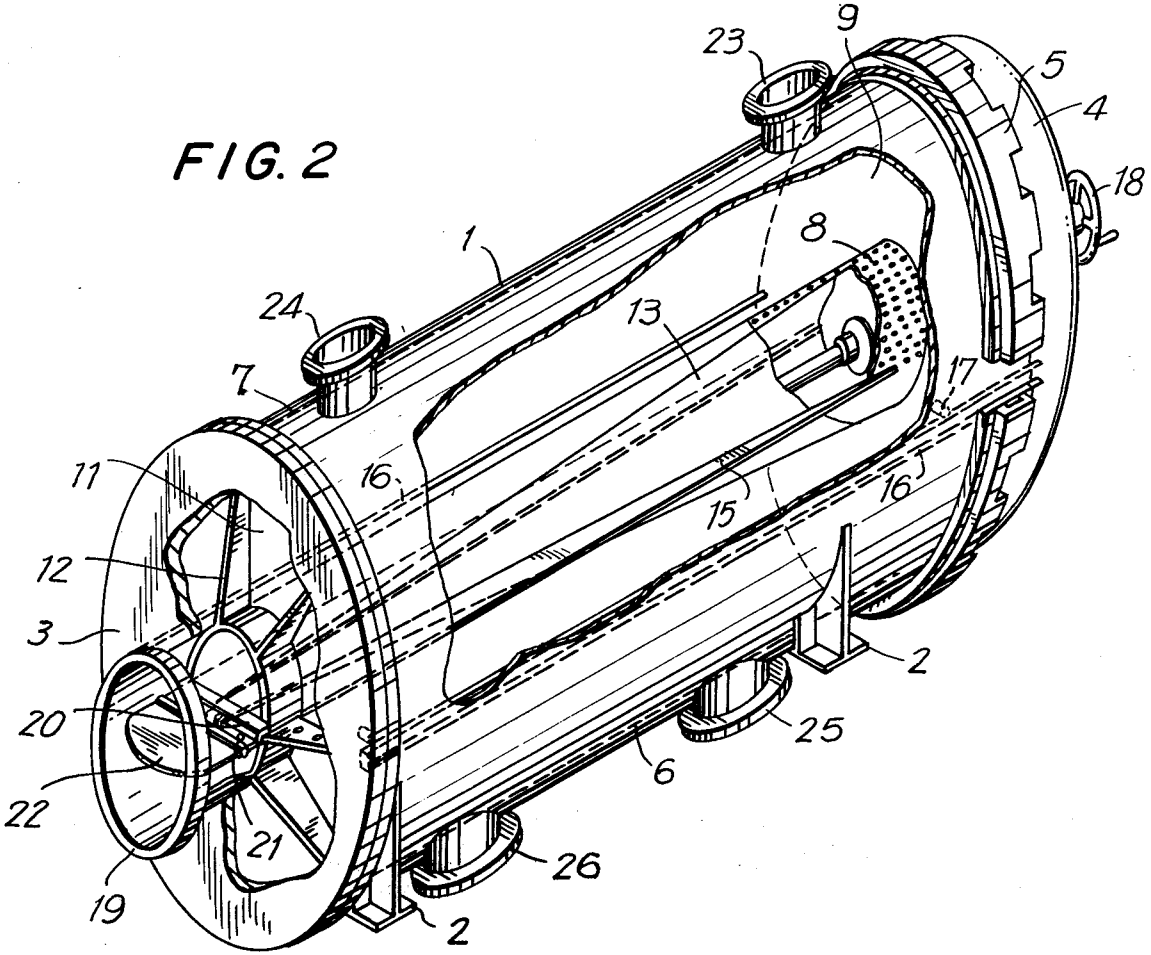
FIG. 2 is a perspective view of the apparatus, partially in section, having portions cut away, to permit easy inspection of the parts.

The improved apparatus according to the invention, comprising a novel combination of new and old parts, comprises essentially:

a. a main cylindrical enclosure closed at its ends with flat or curved bottom plates, one of which may be tightly fixed to said enclosure and the other, which is mounted on a hinge, plays the part of a door to provide access to the interior of the enclosure, but also providing a tight closure.

b. two perforated hemi-cylindrical plates which are placed concentrically, respectively, in the lower and upper parts of the cylindrical enclosure; said plates may be displaced according to a vertical translation.

c. a longitudinal beam which serves to hold the textile materials to be treated, setting on two rails joined to the cylindrical enclosure and formed with a perforated tube fitted with two end discs or flanges (end plates) and sealed at one of its ends, inside of which there are a tight coaxial frustum of a cone and an axial horizontal plate, both joined to the said tube, the said plate being composed of two parts placed on both sides of the frustum of a cone, dividing the inner space included between the perforated tube and the tight cone in two equal volumes.

d. a neck or entry for introducing treatment fluid, joined to the cylindrical enclosure, this neck containing a tip, an horizontal plate dividing the neck in two equal volumes and a rotating shutter joined to the plate.

e. another neck of exit, located on the cylindrical enclosure, for drawing off treatment fluids.

The cylindrical enclosure, which is closed at its ends with flat or curved bottoms, constitutes the vessel in which the treatment of textile materials is effected. One of the two bottoms is tightly fixed to the cylindrical enclosure by any adequate system, such as welding, bolting and so on. The neck for introducing treatment fluid is placed on this bottom, in the axis of the cylindrical enclosure. The other bottom, which plays the part of the access door to the vessel, by which textile materials to be treated are introduced, is mounted on a system enabling it to pivot, said system being joined to the cylindrical enclosure. When the textile materials are introduced into the vessel, the bottom is brought into contact with the cylindrical enclosure, then it is kept in position owing to a system of bolting, such as, for example, a castellated crown or nut, the rotation of which is possible owing to an adequate installation, such as an hydraulic jack or means of mechanical control.

Since the vessel must work under sub- and superatmospheric pressures, the tightness between the cylindrical enclosure and the access door is provided by means of a circular joint which is of a known type, such as inflatable joints made of Teflon (registered trademark for polytetrafluorethylene resins), butyl rubber, etc.

Moreover, inside and in the centre of the door, there is a movable cone which supports the holder of the textile materials in position, the said movable cone being driven from outside by a system consisting of screw and nut.

The sizes of the enclosure or vessel for the treatment are desirably such that the ratio of the length to the diameter may vary from 1 to 10:1.

Within the vessel for treatment, constituted of the cylindrical enclosure and the two bottoms, there are two perforated plates, having a hemi-cylindrical form, called shells, placed facing each other coaxially to the said vessel and joined to a system for moving up and down, which is of a known type, such as hydraulic jack, set of chains, etc., and which permits return or withdrawal of said shells for putting them possibly into contact with the textile material during the treatment operations. The length and the diameter of the said shells are slightly smaller than the sizes of the cylindrical enclosure, they are limited by the angle alpha of the dihedral which is defined by the planes passing through the edges of the shells and through the axis of the cylindrical enclosure. This angle is, broadly, between about 20° and 170°, preferably between about 60° and 120°.

The shells are of great importance to prevent the deformation of the rollings of textile materials when they are permeated by treatment fluids or impregnated with them. They limit the radial motion of said materials which is caused by the combined action of various forces appearing during or after the operations of treatment, such as pressures of fluid passage, Archimede pressure, gravity, etc.

It is possible, indeed, to compensate or favor one or several of these forces by proper adjustment, for example, by loosening the textile material owing to a rising of the lower shell, or by compressing it owing to a closeness of both shells or also by eliminating it completely owing to the separation of said shells.

The holder of textile materials referred to as the beam is formed with a perforated tube which permits the passage of the treatment fluid through said materials, and with discs or flanges which are reinforced at their ends with ailerons or guides, one of said discs closing one of the ends of the said tube while the other, which has a hole the same diameter as the tube, permits the free circulation of the treatment bath. Moreover, the said perforated tube, called the shaft, is provided interiorly with a tight frustum of cone, the length of which is the same as that of the tube and the great base of which is confounded with the referred to closed end. It is also provided with an axial horizontal plate which divides the inner space included between the perforated tube and the tight frustum of cone in two equal volumes. The cone exerts a part of regulator of fluid flow along the perforated tube.

The neck or entry for introducing treatment fluid, joined to the fixed bottom of the cylindrical enclosure, has the same diameter as the perforated tube of the beam. This, neck is provided with an horizontal plate joined to its wall, preceded by a tip joined to the said plate, which permits the junction of said plate with the plate and the frustum of cone in the shaft of the beam.

After the plate, inside the inlet neck, there is a shutter rotating around an axis which permits regulation of the respective flows of the treatment fluid sent to the upper and lower parts of the said neck of the beam. This shutter is driven by means of an outer control such as a pneumatic jack, an electro-magnetic system, etc. Therefore, the treatment fluid which arrives through the inlet neck is divided into two streams, possibly unequal, owing to the presence of the plate of the neck and to the rotating shutter. Also, the tip joint to the plate provides easier penetration, without turbulence, of the two recited streams in the two volumes of the beam shaft. Finally, the main cylindrical enclosure comprises at least a drain-pipe for treatment bath but the said main cylindrical enclosure may also be provided with a group of feeding and discharging pipes permitting the conveying, in addition to the treatment bath, of the various fluids necessary for heating and cooling the introduction of various agents allowing the realization of the treatment, etc. The apparatus may also be provided with means for control and regulation of temperatures, levels, speed of fluid extraction, etc.

SPECIFIC DISCLOSURE OF THE INVENTION

The invention will be described in reference to the figures of drawings.

The apparatus according to the invention consists of a main cylindrical enclosure or vessel 1, joined to a frame 2. The cylindrical enclosure or vessel 1 is closed at its ends with the end 3 and end 4, the end 3 being tightly fixed to the enclosure 1, while the end 4 plays the part of an access door to the cylindrical enclosure 1, allowing the introduction and evacuation of textile materials before and after the treatment. The said end or access door 4 is brought into tight contact with the cylindrical enclosure 1, then it is tightly plated on it owing to a bolting system 5 of a known type and a joint placed between the door and the enclosure which is not represented on the appended drawings.

Within the treatment enclosure 1 there are two perforated hemi-cylindrical plates 6 and 7, called shells, placed facing each other and joined to a known system, which is not represented in the drawings, permitting them to move vertically either together or separately, according to the desired treatment.

The beam which holds the textile materials during the treatment consists of a perforated tube 8, discs or flanges 11, reinforced with ailerons or guides 10 and 12, which serve to limit the lateral motion of the textile materials rolled up on the tube 8 and to insure the tightness at the rolling ends when the treatment bath is circulating inside the said materials. Moreover, the perforated tube is provided internally with a frustum of cone 13 fitted with an axial stiffening tube, the great base 14 of which is in a tight contact with the shell 9. Finally, the perforated tube 8 is divided on its whole length by a plate 15 which divides the inner space comprised between the perforated tube 8 and the cone 13 in two equal volumes.

The beam is introduced in the treatment apparatus by means of a set of rails 16 joined to the main cylindrical enclosure 1 and by means of suitable rollers 17.

After the closing of the door 4, the beam is definitively fixed in a desired position owing to a locking system 18 such as a movable cone, for example, driven by means of an outer system of screw and nut.

The neck 19 for introducing treatment fluid, joined to the end 13 and having the same diameter as the perforated tube 8, is provided with a tip 20 joined to a plate 21. After the plate 21 and inside the neck 19 there is a shutter 22 rotating around an axis, which permits regulation of the fluid flows into the two inner volumes defined by the perforated tube 8, the cone 13 and the plate 15.

Finally, the main cylindrical enclosure 1, closed with the ends 3 and 4, consists of a treatment vat provided with feeding and discharging pipes, such as 23, 24, 25 and 26, for example, or with other pipes which are not represented in the drawings, permitting the continuous removal of treatment fluid, the elimination of at least one of the constituents of this fluid, the reintroduction of the other constituents after said elimination, the recycling of treatment fluid, the introduction of heating and cooling fluids. It is also provided with devices for controlling temperatures, levels of bath, rate of extraction, or introduction of fluids.

The various parts of the installation are constituted with various materials. Metals and metallic alloys which are resistant to corrosion may be used. Some elements may be formed with polymers having good mechanical resistance and being inert to the action of chemical agents.

According to the invention, the apparatus operates as follows: the textile material is wound on the perforated tube 8 and this is then placed into the closed cylindrical enclosure 1, the treatment fluid is introduced through inlet neck 19. Insofar as the fluid exerts forces on the textile material which can deform it, the one and/or the other of the shells 6 and 7 are brought closer to act up on the fabric rolling, or, on the contrary, are lowered. On the other part, if the fluid rates are desired equal in every one of the volumes which are delimited by the tube 8, the cone 13 and the plate 15, the shutter is kept opened. On the contrary, if said rates are desired to be different, and if the fluid is stopped in one of the said volumes, which is necessary during the drying, the shutter is moved for changing suitably the division of the fluid in the two spaces inside the tube 8. The treatment fluid flows continuously or discontinuously during or after an operation by the pipes which are intended therefor. When a liquid is drawn off discontinuously, the shell 6 is advantageously raised for supporting the lower part of the textile bobbin, which avoids the deformation of the fabric.

The following examples will better illustrate the use of the apparatus according to the invention and is presented without limiting the scope of the invention.

EXAMPLE

About 500 meters of a ringlet carpet made of polyamide on a backing of polypropylene, the weight of which being 475 grams per square meter and the width being 404 centimeters are wound on the beam with a regular tension of 10 kilograms per meter. The total weight of the rolled textile material was 960 kg.

Before introducing into the treatment enclosure 1, the total diameter of the bobbin was 1780 mm., 700 mm. of which was constituted by the diameter of the perforated tube, the thickness of the rolled textile being 530 mm. above and 550 mm. under said tube.

The beam was introduced into the autoclave which was then tightly closed.

The operating cycle was as follows:

1. Step 1: dehydration of textile material in hot air:

In this operation, the rotating shutter 22 was kept opened to obtain an air rate substantially equal in every one of the two volumes delimited by the tube 8, the cone 13 and the plate 15. The shells 6 and 7 were also opened, in their nearest position to the cylindrical enclosure.

2. Step 2: dyeing of textile material

The dyeing was effected by the "exhaustion" dyeing in accordance with the process described in U.S. Pat. No. 3,738,803, granted June 12, 1973, in a bath containing a solvent for the dye, such as methanol, and a diluent, such as perchlorethylene, with elimination of the solvent during the dyeing. The dyeing was effected under pressure and the solvent was removed by drawing off a liquid part of the bath, separating the solvent and recycling the diluent.

For filling the treatment enclosure 1 with the bath, the shutter 22 was opened. During the dyeing, the shells 6 and 7 were opened. During the operation, the liquid part of the bath was drawn off through 24 and the diluent was recycled through 19 (the separation of the solvent was effected in an apparatus which is not represented in the drawings).

3. Step 3: drawing off of bath after dyeing:

The shell 6 was raised for supporting the lower part of the textile bobbin, then the bath was totally drawn off through the pipes 25 and 26.

4. Step 4: drying the textile material in hot air:

For this operation, the shell 6 was kept in the same position as during the extraction of the bath. The shutter 22 was closed to prevent the gas arriving directly in the high part of the tube 8. The duration of air passage (at 70°C.) was 65 minutes.

The textile material was then perfectly dry. The fabric rolling measured 530 mm. above and 550 mm. under the beam.

When an identical operating cycle was effected on the same textile material in a conventional prior art installation, a bobbin was obtained, the fabric rolling of which measured 470 mm. above and 650 mm. under the beam. Moreover, the drying was not complete, even after introducing hot air for a period of 2 hours.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. An improved apparatus for batch treatment of textile materials in the form of broad widths which comprises:

a. an enclosure provided with closure means at both ends and said enclosure having lower and upper parts, b. two perforated hemi-cylindrical plates placed concentrically, respectively, in the said lower and upper parts of said enclosure, said plates being movable vertically, c. a holder for the textile materials to be treated setting on two rails joined to said enclosure, said holder comprising a perforated tube provided with two end plates and closed at one of its ends, inside of which perforated tube there are a tight coaxial frustum of a cone and an axial horizontal plate joined to said tube, dividing the space between the perforated tube and the tight cone, into two parts of equal volume, d. a means for introducing treatment fluid, joined to a fixed end of said enclosure, and e. a means for evacuating treatment fluids from said enclosure.

2. An improved apparatus according to claim 1, wherein one of said closed ends of said enclosure is permanently joined to said enclosure.

3. An improved apparatus according to claim 1, wherein said enclosure is substantially cylindrical.

4. An improved apparatus according to claim 1, wherein said enclosure is of substantially cylindrical configuration and has a ratio of length to diameter between about 1 and 10.

5. An improved apparatus according to claim 1, wherein said means for introducing treatment fluid is provided with a fixed plate which divides said means for introducing said treatment fluid into two equal volumes, with a rotating shutter joined to said plate.

* * * * *

UNITED STATES PATENT OFFICE
CERTIFICATE OF CORRECTION

PATENT NO. : 3,974,666

DATED : August 17, 1976

INVENTOR(S) : Jean Paul Coquery et al.

It is certified that error appears in the above-identified patent and that said Letters Patent are hereby corrected as shown below:

Column 5, line 4, "end 13 " should be -- end 3 --.

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*